United States Patent [19]

Dickinson et al.

[11] Patent Number: 4,722,178

[45] Date of Patent: Feb. 2, 1988

[54] FRICTION SPINNING APPARATUS

[75] Inventors: Peter J. Dickinson; Douglas O. Clough, both of Rossendale, England

[73] Assignee: Hollingsworth, U.K. Ltd., Lancashire, England

[21] Appl. No.: 791,387

[22] Filed: Oct. 25, 1985

[30] Foreign Application Priority Data

Oct. 29, 1984 [GB] United Kingdom ..... 8427292

[51] Int. Cl.[4] ..... D01H 7/882; D01H 1/135

[52] U.S. Cl. ..... 57/401; 57/408; 57/415

[58] Field of Search ..... 57/401, 400, 404, 408, 57/405, 415, 261, 263, 264

[56] References Cited

U.S. PATENT DOCUMENTS

| | | | |
|---|---|---|---|
| 4,367,623 | 1/1983 | Parker et al. | 57/263 |
| 4,380,892 | 4/1983 | Parker et al. | 57/401 |
| 4,502,272 | 3/1985 | Fuchs | 57/401 |

FOREIGN PATENT DOCUMENTS 0052412 5/1982 European Pat. Off. .

*Primary Examiner*—John Petrakes
*Attorney, Agent, or Firm*—Cort Flint

[57] ABSTRACT

The mask sleeve within the perforated roller of each spinning unit of a multi-position friction spinning apparatus is adjustable to move the suction slot of that roller between extreme positions in which an edge of the slot crosses from one side of the friction spinning nip to the other. Adjustment at each spinning unit is effected independently of the various other units of the machine by means of a rotary adjuster engaging a bifurcated end of a carrier which is itself adjustably fastened (by way of a clamp bolt) with respect to the masking cylinder. The adjuster and the carrier are outside the machine and allow adjustment of the positioning of the slot deep within the spinning unit for fine tuning purposes.

18 Claims, 2 Drawing Figures

FRICTION SPINNING APPARATUS

FIELD OF THE INVENTION

The present invention relates to friction spinning apparatus, of the general type incorporating a pair of closely spaced rotors which define a yarn formation line at a nip between the rotors, and at least one of those rotors is foraminous with an adjustable internal mask defining a suction slot extending substantially parallel to the nip to confine the application of suction within the foraminous rotor.

PRIOR ART

Friction spinning apparatus including two side-by-side suction drums with stationary suction slots parallel to the nip between the two rotors of which the suction drum is but one, are well known.

Our Published European Pat. No. 0,052,412 discloses such a friction spinning machine one imperforate roller, and one foraminous roller enclosing two internal sleeves. The first of these sleeves is stationary, and just inboard of and in very close proximity to the foraminous member defining the exterior of the roller, and has a single parallel-sided slit defining a suction slot to define the location of the application of suction to the nip. The second and inner of these two sleeves is rotatable in order to re-position a parallelogram-shaped slot therein during piecing and rotor cleaning, this parallelogram-shaped slot being arranged with its longer sides inclined with respect to the parallel sides of the suction slot in the stationary sleeve. Of these two sleeves, the present invention is concerned with the stationary outer sleeve.

However, more recently it has been proposed in West German Offenlegungsschrift No. 3340825 to provide a shaft extending along a multi-position friction spinning machine connected to the outer sleeves of the suction drums of all the spinning units so as to enable the positions of all the sleeves to be reset for varying a spinning parameter such as the yarn count.

The field of the present invention extends to rotors of other than cylindrical form, for example skew axis hyperboloidal rollers, and to any such form of twin-rotor friction spinning machine with both rotors foraminous if desired.

OBJECT OF THE INVENTION

In the above mentioned prior art multi-position friction spinning unit with means for adjusting slot settings, it was a disadvantage that any lost motion in the adjustment linkages added to any discrepancies between the slot settings of the various spinning units resulting from manufacturing tolerances. It is an object of this invention to overcome that disadvantge.

SUMMARY OF THE INVENTION

According to the present invention we now provide multi-position friction spinning apparatus comprising a plurality of spinning units each having: a pair of closely spaced rotors defining a yarn formation line at the nip between the two rotors, at least one of the rotors being foraminous; a mask within said foraminous rotor defining an elongate suction slot substantially parallel to the nip between the two rotors to confine the application of suction to the interior of the foraminous rotor; and means for adjusting the position of the mask of that spinning unit for changing the position of the suction slot relative to the nip of that spinning unit independently of the settings of the other spinning units of the multi-position machine.

Preferably the position of the suction slot is adjustable such that it may be at least partly on the side of the nip away from that from which the fibre feed stream is directed at the nip.

Advantageously the adjustment means is positoned outside a main housing of the friction spinning apparatus and includes a scale to indicate to the operative the degree of movement of the suction slot from a datum position.

In friction spinning, there are various parameters which may be varied in a production environment and which may give rise to the need for fine tuning of the friction spinner. Such variables include the yarn count to be spun, the nature of the fibres to be spun, the mean fibre length of the material to be spun, and the rate of production, among others. By the ability to adjust the position of the suction slots in the various spinning units of the friction spinning apparatus in accordance with the present invention we have enabled the fundamental settings of the individual spinning units to be varied on the production machine in a manner which hitherto may only have been possible under laboratory conditions. By adjusting the slot positions of the masks within each of the individual perforated rotors of a multi-station friction spinning machine independently of one another, not only can the settings be changed to accommodate a variation in one of the above-mentioned spinning parameters along the whole multi-position machine, but also it is possible to tune for improved spinning quality and reliability on each individual spinning unit.

BRIEF DESCRIPTION OF THE DRAWINGS

In order that the present invention may more readily be understood the following description is given, merely by way of example, with reference to the accompanying drawings in which.

DESCRIPTION OF THE PREFERRED EMBODIMENT

Figure 1:
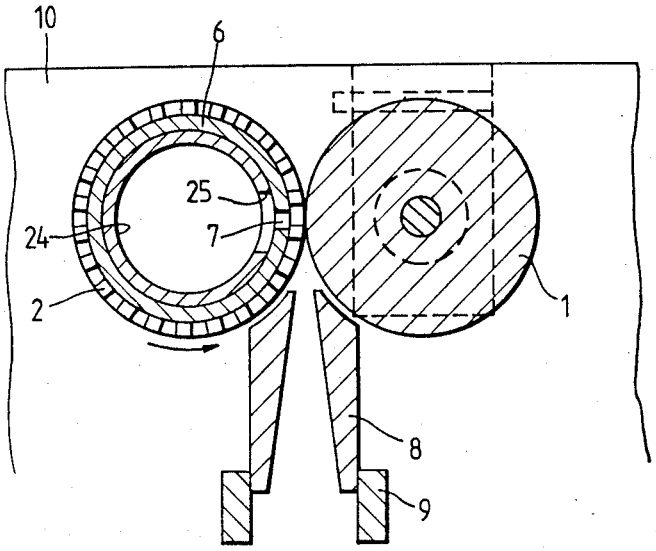
FIG. 1 shows a schematic sectional view of a friction spinning apparatus in accordance with the present invention.

As shown in FIG. 1, friction spinning rotors 1 and 2 are rotatably mounted within a housing 10 and define a nip towards which fibres from a fibre opening unit 9 are directed along a fibre feed duct 8.

In a manner which is well illustrated in our above mentioned European Patent Publication No. 0.052,412, the solid roller 1 is pivotable to separate the two rollers 1 and 2 for purposes of cleaning the friction spinning chamber, and details of this are not necessary to an understanding of the present invention.

The foraminous roller 2 comprises two internal sleeves of which the outer, 6, is the stationary mask defining the suction slot 7 adjacent the nip between the two rollers 1 and 2, and the inner, 24, is the movable mask defining a masking slot 25 of parallelogram shape as described in detail in European Patent Publication No. 0,052,412, the disclosure of which is incorporated herein by reference.

As indicated in European Patent Publication No. 0052412 the inner mask sleeve 24 has a central position in which the entire length of the suction slot 7 of the outer mask is exposed to suction from within the mask 24, and has a first range of positions when moved anticlockwise from that datum position shown in FIG. 1 (applicable during rotor cleaning) in that it progressively closes off the suction from one end of the suction slot 7 and hence induces excess fibre material to move along the nip towards the other end thereof, and has another range of positions applicable during the clockwise rotation of the mask cylinder 24 applicable during piecing in order to cause the suction to be shut off progressively towards the one end, thereby inducing the already partially inserted seed end of the yarn (introduced through the yarn doffing tube while the suction slot 7 is fully open) to move along the direction of the nip into a pre-piecing position.

Figure 2:
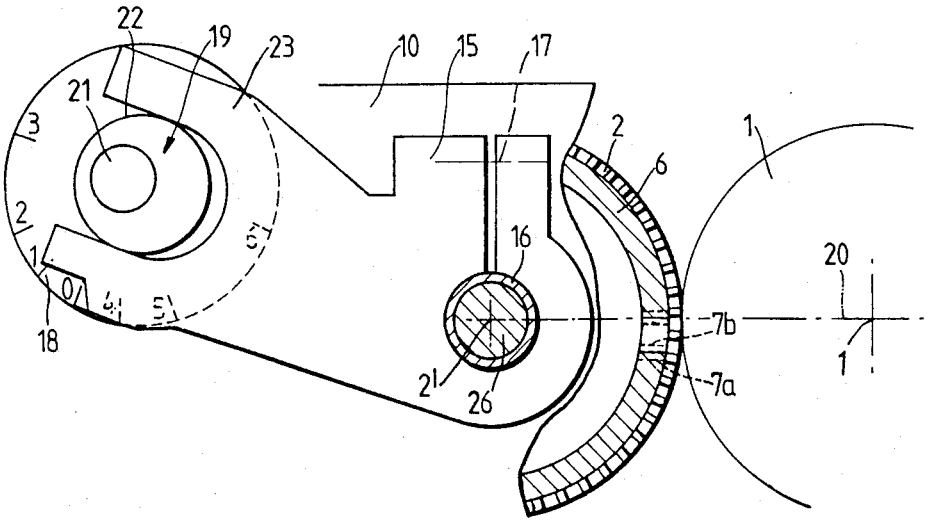
FIG. 2 shows a part end elevational and partial sectional view of the apparatus of FIG. 1, but illustrating the adjustment means for the masking sleeve defining the suction slot.

The outer mask sleeve 6 is adjustable in position by rotation of a carrier 15 which is clamped, (by way of a clamp bolt whose centre line 17 is illustrated in FIG. 2) about an end collar 16, which is both integral with the outer mask sleeve 6 and rotatable relative to the shaft 26 of the mask 24. The means for moving the mask sleeve 24 and shaft 26 are clearly disclosed in European Patent Publication No. 0,052,412.

Rotation of collar 16 allows the carrier to be set up so that in a datum position, indicated by the "zero" position on an indicating scale 18 of an adjuster 19, the position of the suction slot 7 has the appropriate orientation relative to the line 20 indicating the plane which includes the (in this case) parallel axes of rotation 1' and 2', respectively, of the rotors 1 and 2.

FIG. 2 also illustrates two alternative positions of the slot 7 by reference to the alternative positions *7a* and *7b*, respectively, of the lower edge of the suction slot 7. However, it will be understood that the two positions *7a* and *7b* are simply representative of adjustments to either side of a datum position and that other possible locations for the slot may be provided for within the range of adjustment offered by the adjuster 19. It should be noted that the upper edge of the suction slot 7 is, in position *7b* and in any other positions on that same side of the datum configuration shown in full lines in FIG. 2, above the plane 20 which includes the parallel axes of rotation 1' and 2' of the rotors. In other words, this apparatus includes a facility for the surprising step of positioning at least a part of the suction slot 7 behind (in this case above) the yarn formation nip.

The adjuster 19 has fixed axis of rotation defined by a mounting shaft 21 and has an eccentric disc 22 which fits snugly within a bifurcated end 23 of the carrier 15, substantially without lost motion.

As will be understood from FIG. 2, when the adjuster 19 is rotated in the clockwise direction from the position illustrated, the carrier will rotate in the anticlockwise direction and will raise the suction slot 7 towards, and possibly beyond, the position *7b*. Motions in the reverse sense apply when the adjuster is moved to bring positions 1, 2 and 3 of the scale 18 into register with the zero mark.

It must be emphasized at this stage that during normal operation of a multi-station friction spinning apparatus incorporating the present invention the adjusters 19 and carriers 15 for each of the various perforated rollers 2 will be stationary, even during piecing and during rotor cleaning. Adjustment will be made only when it is desired to compensate for change in some operating parameter of the apparatus or if for some other reason the slot setting needs correction during the life of the multi-position machine, for example to accommodate variations due to manufacturing tolerances when commissioning a new spinning unit.

On the other hand, the position of inner masking sleeve 24 (not shown in FIG. 2) is changed both during rotor-cleaning and during a pre-piecing operation to induce movement of the seed end of yarn therealong, and thus its orientation is defined by biasing towards a central position and controlled manipulation to bring it towards either of its displaced "end-of-travel" positions at the appropriate time in the cleaning and piecing cycle, either at the will of an operative in the case of a manually controlled machine, or when signalled by a piecer-cleaner robot in the case of a fully automatic machine.

With the above in mind, it may be desirable to incorporate some means of locking the adjuster 19 in position so that it does not vibrate into a new position in which the setting of the suction slot 7 has changed.

It will of course be appreciated that although an eccentric cam is used, in the preferred embodiment, as the means for adjusting the collar 16 and outer mask 6, any other form of adjuster which allows the position of the slot 7 to be adjusted without gaining access to the interior of the spinning chamber would be a practical alternative. For example, the bracket 15 may be adjusted by means of an individual tangential screw or an individual worm wheel.

We claim:

1. In a multi-position friction spinning machine comprising a plurality of spinning units each having (a) first and second closely spaced friction spinning rotors, at least said first friction spinning rotor including foraminous sleeve means defining the surface thereof and rotatable about an axis, and said first and second friction spinning rotors defining a nip;

(b) a mask means within said first friction spinning rotor defining an elongate air suction slot substantially parallel to said nip between the first and second friction spinning rotors to confine a suction-induced airflow through said foraminous first friction spinning rotor to a suction region of said first friction spinning rotor which has a predetermined position relative to said nip; and (c) mask adjusting means for adjusting said mask means and predetermined position of said suction region without needing to dismantle the first friction spinning rotor, and said mask means comprising a mask immediately adjacent said foraminous sleeve and connected to said mask adjusting means for effecting rotation of said mask relative to said axis of rotation of the foraminous sleeve means;

the improvement wherein said mask adjusting means of each said spinning unit is independent of the mask adjusting means of the other said spinning units of the same friction spinning machine, thereby allowing adjustment of the position of the mask within any one said first friction spinning rotor independently of the positions of the masks within the first friction spinning rotors of the other spinning units of the machine.

2. A friction spinning unit according to claim 1, wherein said second friction spinning rotor of each spinning unit is foraminous with a said adjustable mask, and including respective means for adjusting the mask of each second friction spinning rotor independently of the settings of the second friction spinning rotors of the other spinning units.

3. A friction spinning machine according to claim 1, wherein the range of positions of the suction slot includes positions in which an edge of said suction slot moves from one side of said nip to the other side thereof.

4. A friction spinning machine according to claim 1, wherein each of said spinning units includes a housing; and wherein said means for adjusting the position of said mask includes a carrier for said mask and an adjuster located outside said housing of the friction spinning unit, for setting the position of said carrier.

5. A friction spinning machine according to claim 4, wherein said adjuster includes an indicating scale with indicia to represent the position of said suction slot.

6. A friction spinning machine according to claim 4, including means adjustable securing said carrier to the mask, for factory setting of the adjuster.

7. A friction spinning machine according to claim 1, wherein said first friction spinning rotor includes an outer foraminous sleeve and said mask is a sleeve closely spaced from, and just within, said foraminous sleeve.

8. In a multi-position friction spinning machine comprising a plurality of spinning units each having (a) a housing (b) first and second closely spaced friction spinning rotors, at least said first friction spinning rotor being foraminous and said first and second friction spinning rotors defining a nip;

(c) a mask within said first friction spinning rotor defining an elongate suction slot substantially parallel to said nip between the first and second friction spinning rotors to confine the application of suction to the interior of the first friction spinning rotor; and (d) means for adjusting the position of said mask for chaning the position of the suction slot relative to the nip without needing to dismantle the first friction spinning rotor;

the improvement wherein said mask-adjusting means of each said spinning unit comprises (i) a rotatable shaft;

(ii) an eccentric mounted on said shaft; and (iii) a carrier for said mask, said carrier having a bifurcated end co-operating with said eccentric, said eccentric being located outside said housing of the friction spinning unit and rotatable for setting the position of said carrier relative to said housing independently of the eccentrics of the mask adjusting means of the other said spinning units of the same friction spinning machine, thereby allowing adjustment of the position of the mask within any one said first friction spinning rotor independently of the positions of the masks within the first friction spinning rotors of the other spinning units of the machine.

9. In a multi-position friction spinning machine comprising a plurality of spinning units each having (a) first and second closely spaced friction spinning rotors, at least said first friction spinning rotor including a foraminous outer sleeve, and said first and second friction spinning rotos defining a nip;

(b) a mask within said first friction spinning rotor and closely spaced from said foraminous sleeve and defining an elongate suction slot substantially parallel to said nip between the first and second rotors to confine the application of suction to the interior of the first friction spinning rotor; and (c) means for adjusting the position of said mask for changing the position of the suction slot relative to the nip without needing to dismantle the first friction spinning rotor;

(d) a masking sleeve positioned just within and closely spaced from said mask to define a further slot; and (e) means for moving said further slot relative to said first mentioned slot for opening and closing communication of the first mentioned slot with the interior of said masking sleeve;

the improvement wherein said mask-adjusting means of each said spinning unit is independent of the mask adjusting means of the other said spinning units of the same friction spinning machine, thereby allowing adjustment of the position of the mask within any one said first friction spinning rotor independently of the positions of the masks within the first friction spinning rotors of the other spinning units of the machine.

10. A friction spinning machine according to claim 9, wherein the range of positions of the suction slot includes positions in which an edge of said suction slot moves from one side of said nip to the other side thereof.

11. A friction spinning machine according to claim 9, wherein each of said spinning units includes a housing; and wherein said means for adjusting the position of said mask includes a carrier for said mask and a adjuster located outside said housing of the friction spinning unit, for setting the position of said carrier.

12. A friction spinning machine according to claim 11, wherein said adjuster includes an indicating scale with indicia to represent the position of said suction slot.

13. A friction spinning machine according to claim 11, including means adjustable securing said carrier to the mask, for factory setting of the adjuster.

14. A friction spinning machine according to claim 11, wherein said adjuster comprises a rotatable shaft and an eccentric mounted on said shaft, and wherein said carrier includes a bifurcated end co-operating with said eccentric.

15. A friction spinning machine according to claim 8, wherein each of said spinning units includes a housing; and wherein said means for adjusting the position of said mask includes a carrier for said mask and an adjuster located outside said housing of the friction spinning unit, for setting the position of said carrier.

16. A friction spinning machine according to claim 15, wherein said adjuster includes an indicating scale with indicia to represent the position of said suction slot.

17. A friction spinning machine according to claim 15, including means adjustable securing said carrier to the mask, for factory setting of the adjuster.

18. A friction spinning machine according to claim 9, including operator-controlled means for moving the masking sleeve from time to time during the operating cycle of the apparatus.

* * * * *